US005123454A

United States Patent [19]

Debaes

[11] Patent Number: 5,123,454

[45] Date of Patent: Jun. 23, 1992

[54] CROSSING DEVICE FOR THE PRODUCTION OF NON-FRAYING EDGES OF A DOUBLE WOVEN FABRIC ON A DOUBLE-RAPIER LOOM

[75] Inventor: Johnny Debaes, Wenduine, Belgium

[73] Assignee: N.V. Michel Van de Wiele, Kortrijk, Belgium

[21] Appl. No.: 664,636

[22] Filed: Mar. 4, 1991

[30] Foreign Application Priority Data

Apr. 4, 1990 [EP] European Pat. Off. ..... 90106428.7

[51] Int. Cl.[5] ..... D03C 7/06

[52] U.S. Cl. ..... 139/54

[58] Field of Search ..... 139/53, 54, 116.2

[56] References Cited

U.S. PATENT DOCUMENTS

| | | | |
|---|---|---|---|
| 3,369,570 | 2/1968 | Lacy | 139/54 |
| 4,614,210 | 9/1986 | Debaes | 139/54 |
| 4,635,686 | 1/1987 | Terasaki | 139/116.2 |

FOREIGN PATENT DOCUMENTS

| | | | |
|---|---|---|---|
| 0152956 | 8/1985 | European Pat. Off. . | |
| 2442914 | 9/1975 | Fed. Rep. of Germany . | |
| 3318715 | 11/1984 | Fed. Rep. of Germany . | |
| 1411838 | 8/1965 | France | 139/54 |
| 8701398 | 3/1987 | World Int. Prop. O. | 139/54 |

*Primary Examiner*—Andrew M. Falik
*Attorney, Agent, or Firm*—Toren, McGeady & Associates

[57] ABSTRACT

A method for the production of non-fraying edges of a double woven fabric on a double-rapier loom, using a double shed crossing device comprising per shed a needle carrier, an oblique slot plate and a positioning device, characterized in that, in case of alternate weft insertion in the upper and the lower shed, a first shed positioning with crossing threads being guided between the stationary needles remains simultaneously for the upper shed and the lower shed over two successive and alternate wefts, with the preparation of the changeover of the crossing thread and the stationary thread for the next shed positioning.

9 Claims, 3 Drawing Sheets

CROSSING DEVICE FOR THE PRODUCTION OF NON-FRAYING EDGES OF A DOUBLE WOVEN FABRIC ON A DOUBLE-RAPIER LOOM

BACKGROUND OF THE INVENTION

1. Field of the Invention

The invention relates to a method for the production of non-fraying edges of a double woven fabric on a double-rapier loom, using a double-shed crossing device, said crossing device comprising per shed a needle carrier with at least one elongated stationary needle, said stationary needle having two ends, one end of which, the fastening end, being fixed to said needle carrier, the other, free end being provided with a needle eye for the guidance of a stationary thread, said needle carrier being movable between a first end position and a second end position, a slot plate with at least one oblique slot for the guidance of a crossing thread, said slot plate being movable between a first end position and a second end position, a positioning device, in particular a perforated plate, with at least one eye for the positioning of said crossing thread in the respective oblique slot of said slot plate for the changeover of said crossing thread relative to an associated stationary thread by a corresponding shift of said positioning device relative to said slot plate, said positioning device being movable between a first end position and a second end position, the method comprising the following steps:

weft insertion in the respective shed in a first shed positioning of said crossing device between said stationary threads and said crossing threads, said crossing threads being guided past said stationary needles between said free end and said fastening end thereof, said needle carrier being in its first end position and said slot plate being in its first end position, and changeover of said respective crossing thread in relation to said stationary threads in the respective shed in a second shed positioning of said crossing device with said crossing threads running outside of the region of said stationary needles, said needle carrier, said slot plate and said positioning device being in their respective second end position.

2. Description of the Related Art

A double-shed crossing device to perform this method is known (DE-U No. 8005822; EP-B1 No. 0152956). In the case of these double-shed crossing devices, the needle carriers associated with the two sheds are fixed to a first main carrier and the slot plates are fixed to a second main carrier. Both main carriers carry out periodical lifting movements with a height of the lifting corresponding to the lifting of the shed with a phase shift relative to one another. At least in one of the two sheds the shift of the respective positioning device takes place at the change-over of the respective crossing thread while the shed is in its second shed positioning. The cross weave resulting in the upper woven fabric of the double woven fabric corresponds in its structure to the cross weave in the lower fabric, however, with an inevitable phase shift (of, for instance, one weft).

Double woven fabrics manufactured on double-rapier looms have in the case of double weft insertion the same weaving structure as a double woven fabric manufactured on a single-rapier loom (one pile loop per weft), only if warp threads are used which are guided in opposite directions. This weaving in opposite direction, however, requires double the amount of warp threads and correspondingly a jacquard loom with double capacity. In order to avoid this, that is to say to be able to operate with the single amount of warp threads, in case of a double-rapier loom, every second weft insertion can alternately be omitted in the upper shed and the lower shed.

SUMMARY OF THE INVENTION

The object of the invention is to provide a method of the type mentioned at the outset, which makes possible the manufacture of non-fraying edges of a double woven fabric with alternate weft insertion.

This object is achieved in that in the case of alternate weft insertion in said upper shed and in said lower shed, (a) at least in the period between two successive weft insertions, said crossing device dwells in said first shed positioning for the upper shed as well as for the lower shed and (b) during said period shifting the respective positioning device from its first end position towards its second end position for preparing the following changeover after transition of said crossing device in said second shed positioning.

In comparison to the state of the art mentioned at the outset, the first shed positioning for the upper shed is carried out in synchronism with the first shed positioning for the lower shed. This makes it possible to prepare the changeover in the second shed positioning for both sheds. Due to this preparation, the crossover of the crossing thread over the respective stationary thread is effected abruptly at the beginning of the second shed positioning, so that the crossover immediately runs off into the direction of the finished fabric and is at the following transition into the first shed positioning pushed from the stationary thread further forward to the finished fabric. In case of an entirely open shed in the first shed positioning, the next weft is placed for certain between the crossing thread and the stationary thread, the crossover being disposed between the finished fabric and the weft thread. The following stroke of the weaving reed reliably binds the crossover.

If a double shed crossing device with alternate weft insertion was used, as known from EP-B1-0152956, at least in one of the two subfabrics of the double woven fabric the edge would not be developed sufficiently non-fraying, because, due to the inevitable phase-shift between both subfabrics, the shift of the positioning device for the changeover, which takes place simultaneously in both sheds, leads to an immediate changeover in one of the sheds and merely prepares the changeover in the other shed after a following change of shed.

According to an advantageous embodiment of the method according to the invention, it is envisaged that said first shed positioning and said second shed positioning immediately succeed one another alternatingly and that for the transition from said first to said second shed positioning and vice versa said needle carrier and said slot plate each perform a lifting movement with a height slightly exceeding half of the maximum distance of said stationary threads from said crossing threads in said first shed positioning, thereby forming an open shed in said first shed positioning and a closed shed in said second shed positioning. Since only a lifting movement of a lifting height corresponding to approximately half of the lifting of the shed is to be performed, the mechanical stress on the crossing device is correspondingly reduced even in case of high weaving speeds (increased tool-life) or the working speed of the crossing device used can correspondingly be increased.

Sufficient time for preparation in the case of simple control of the positioning device is guaranteed in that step b) is performed between the insertion of said two successive wefts. Step b) is therefore performed approximately at the half-time of the positioning time of the first shed positioning; the frequency with which step b) is to be performed corresponds to half the frequency of the change of shed (change between the first and the second shed positioning).

The invention relates as well to a crossing device, comprising per shed a needle carrier with at least one elongated stationary needle, said stationary needle having two ends, one end of which, the fastening end, being fixed to said needle carrier, the other, free end being provided with a needle eye for the guidance of a stationary thread, said needle carrier being movable between a first end position and a second end position, a slot plate with at least one oblique slot for the guidance of a crossing thread, said slot plate being movable between a first end position and a second end position, a positioning device, in particular a perforated plate, with at least one eye for the positioning of said crossing thread in the respective oblique slot of said slot plate for the changeover of said crossing thread relative to an associated stationary thread by a corresponding shift of said positioning device relative to said slot plate, said positioning device being movable between a first end position and a second end position, and a first and a second main carrier which are movable in a vertical direction in relation to each other, said needle carrier of one of said two sheds being attached to one of said two main carriers and said slot plate of the one shed being attached to the respective other main carrier, a third main carrier to which said positioning devices of said two sheds are attached and which is movable in the vertical direction in relation to said first and second main carrier, especially for the performance of the aforedescribed method.

In order to be able to manufacture a double woven fabric with simple structural means with a cross-weave structure of the upper and lower fabric being disposed one on top of the other and free of phase shifts, particularly for the production of double woven fabrics with alternate weft insertion, it is proposed that said needle carrier of said upper shed and said slot plate of said lower shed are fixed to said first main carrier, that said needle carrier of said lower shed and said slot plate of said upper shed are fixed to said second main carrier, and that said two main carriers carry said needle carriers and said slot plates staggered in such a way that said needles of said needle carriers each are disposed at that side of said slot plate which faces the finished fabric.

Due to the simple structure of this crossing device, the method according to the invention is preferably performed with this crossing device, even if the performance of the method seems possible by means of two crossing devices one for each shed, which work independently from one another.

In order to obtain the desired staggering of the needle carrier and slot plate in both sheds by simple structural means, it is proposed that one of said two main carriers is provided with a right-angle bend for mounting its needle carrier at one side of the other main carrier and for mounting its slot plate at the other side of the other main carrier.

A particularly simple structure is achieved if the main carriers are each movable by a system of pivoted levers. Especially, it is preferred, that said system of pivoted levers is a parallelogram linkage.

BRIEF DESCRIPTION OF THE DRAWINGS

The invention is explained in greater detail hereinafter with reference to a preferred example of embodiment illustrated in the drawings, in which.

DETAILED DESCRIPTION OF THE PREFERRED EMBODIMENTS

Figure 1:
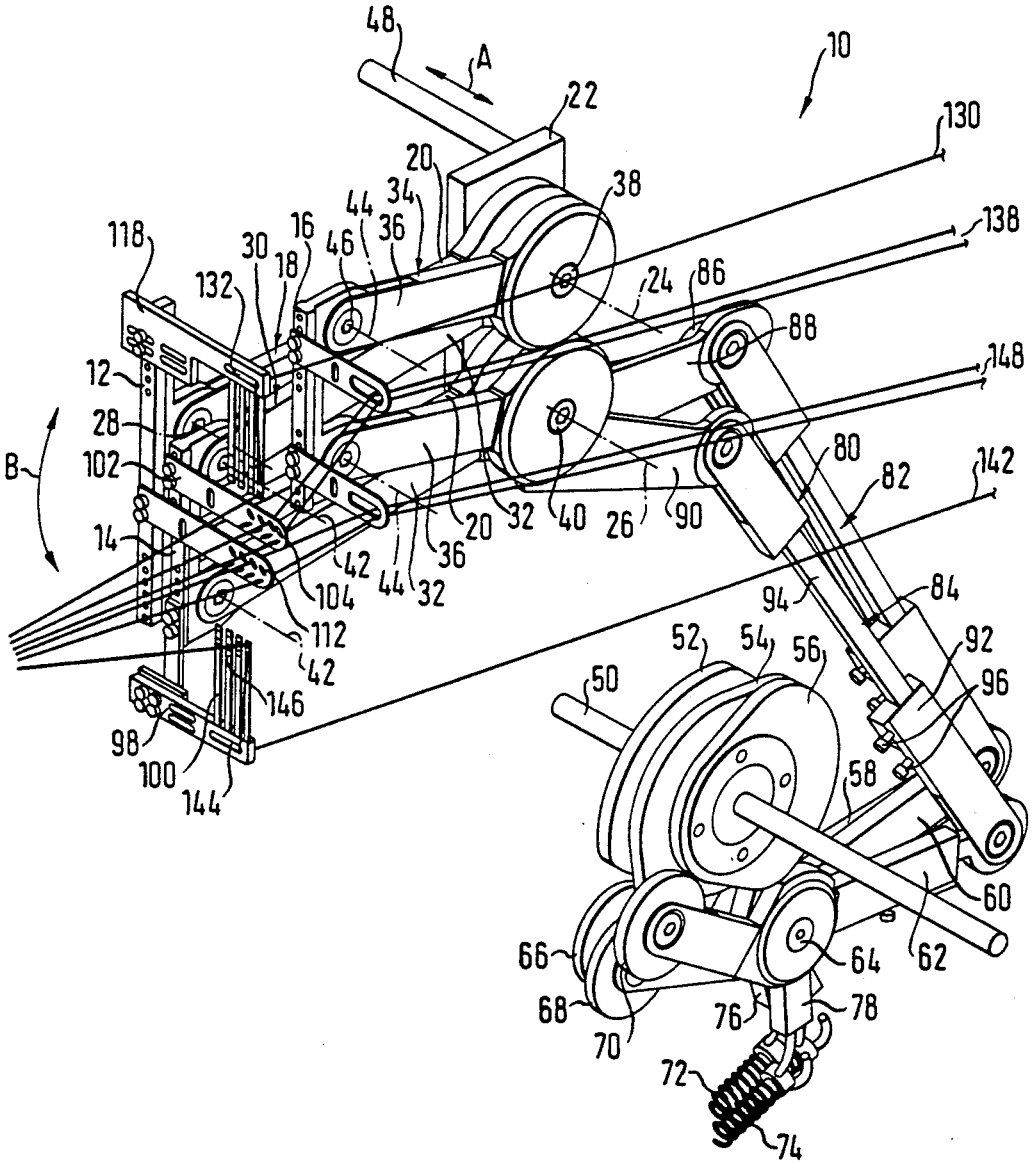
FIG. 1 is a general perspective view of the double-shed crossing device according to the invention.
Figure 2:
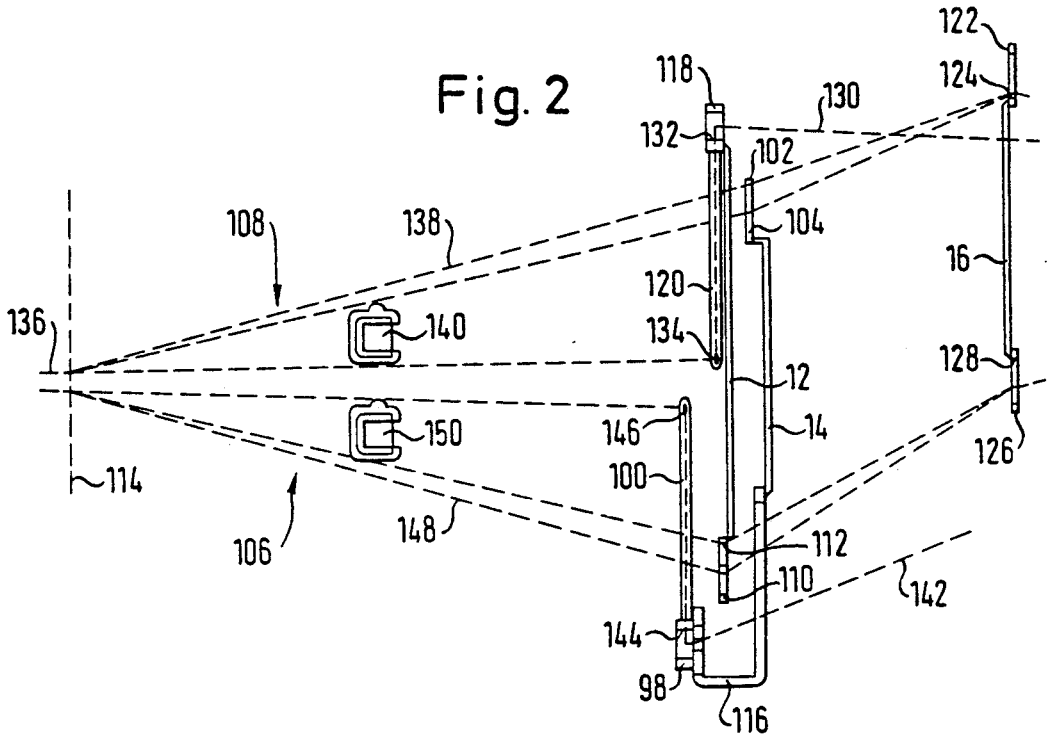
FIG. 2 is a simplified side view of parts of the device according to FIG. 1.

The basic structure of the crossing device of a double-rapier loom for the weaving of double woven fabrics, shown in a simplified form in FIGS. 1 and 2, and designated 10, is first explained in principle, and then the manufacturing of a double woven fabric with non-fraying edges and alternate weft insertion in the upper and lower fabric with the help of this crossing device 10.

In a series of construction details, the basic structure of the crossing device 10 corresponds to the crossing device known from EP-B1 No. 0152956. There, too, three main carriers are provided i.e. a first main carrier 12, a second main carrier 14 and a third main carrier 16, which are each movable in the vertical direction along an arc of a circle with the help of a system of pivoted levers related to each main carrier 12, 14, 16. In the example of embodiment shown, the systems of pivoted levers each consist of a parallelogram linkage. The parallelogram linkage 18 related to the main carrier 12 is formed by two parallelogram rods 20. With their right-hand ends, shown in FIG. 1, these rods 20 are pivotably mounted on a carrier 22 with pivot axes 24 and 26 lying almost vertically one over the other.

With their two other ends, in FIG. 1 the left-hand ends, the two parallelogram rods 20 are articulated to the first main carrier 12. In FIG. 1 only the upper joint can be seen with the pivot axis 28.

Accordingly, the parallelogram linkage 30 connecting the carrier 22 with the second main carrier 14 is formed by two parallelogram rods 32. Both are again articulated to the carrier 22 for pivoting again around the pivot axes 24 and 26. With their other ends the parallelogram rods 32 are articulated to the second main carrier 14.

The parallelogram linkage 34 which is related to the third main carrier 16 likewise consists of two parallelogram rods 36 articulated to the carrier 22 and pivotable around the axes 24 and 26 and with an articulated connection to the third main carrier 16. In the example of the embodiment shown, the pivot joints of the parallelogram rods 20, 32 and 36 with the pivot axes 24 and 26 are formed by two pivotal bearing bolts 38, 40 protruding horizontally from the carrier 22 and being parallel to each other, onto which the corresponding ends of the parallelogram rods 20, 32 and 36 constructed as circular discs are fitted.

The pivot joints formed by the left ends of the parallelogram rods 20, 32 and 36 as shown in FIG. 1, with the respective main carriers 12, 14 and 16, and having the pivot axes 28 (at the first main carrier 12), 42 (at the second main carrier 14) and 44 (at the third main carrier 16), can be formed in that the corresponding end of the parallelogram rod 20, 32 and 26 encompasses the respective main carrier 12, 14 and 16 in a fork-like manner with a bearing bolt 46 interspersing the fork.

The carrier 22 can be moved for the adjustment to the respective fabric width of the double woven fabric in the direction of the double arrow A (i.e. parallel to the pivot axes 24 and 26, 28, 42 and 44) on a loom frame which is not shown. In this case, an adjusting peg 48 projecting from the back of the carrier 22 is used.

The motion drive for the parallelogram linkages 18, 30 and 34, necessary to move the main carriers 12, 14 and 16 in the direction of the double arrow B indicated in FIG. 1, is effected by three cam discs 52, 54 and 56 fixed to a primary shaft 50. For the adjustment of the fabric width already mentioned above, the cam discs 52, 54 and 56 are optionally movable in the direction of the axis of the primary shaft, i.e. parallel to the double arrow A.

Each cam disc 52, 54, 56 is associated with a tracking double arm lever 58, 60, 62 with a common weaving frame-securing bearing shaft 64 (likewise with a possibility of adjustment in the direction of the bearing shaft 64 parallel to the double arrow A). At their lefthand ends, as shown in FIG. 1, the double-arm levers are each provided with a tracking wheel 66, 68, 70, which rolls onto the circumference of the associated cam disc 53 or 54 or 56 and is pressed against the surface of the circumference owing to a spring pretension by means of an adjustable helical draw spring. In FIG. 1, two of these draw springs 72, 74 are visible, which each engage in one projecting part 76 or 78 protruding from the double arm 60 or 62 in the region of the bearing shaft 64.

The right ends of the double arms 58, 60, 62 as shown in FIG. 1, are each articulated to a rear extension 86, 88 and 90 of the respective lower parallelogram arm 20 or 32 or 36 of the parallelogram linkages 18, 30 and 34 through a connecting lever 80, 82, 84 which is adjustable lengthwise.

In order to adjust, for example, the connecting lever 84 lengthwise, it is provided with a housing part 92 at its lower end, in which a rod part 94 can be inserted and which can be fixed to the desired longitudinal position by means of adjustment screws 96.

A needle carrier 118 with needles 120 projecting vertically downwards is attached to the upper end of the first main carrier 12 and slot plate 110 with oblique slots 112 at the lower end. As FIG. 2 shows, the needles 120 serve to form the upper shed 108 and the oblique slots 112 serve to form the lower shed 106. The needles 120 are basically situated vertically above the oblique slots 112.

At the second main carrier 14 in the region of its upper end there is attached a slot plate 102 with oblique slots 104 related to the upper shed 108, in fact on that side of the needles 120 which is opposite to the finished woven fabric (in FIG. 1 on the left-hand side of a weaving reed beating-in line 114). In order to obtain the same succession of the needles and the oblique slots in the lower shed 106, the second main carrier 14 is provided with right-angle bend 116 at its lower end for the mounting of a needle carrier 98 with needles 100 located in front of the oblique slots 112.

At the third main carrier 16, a horizontal slot plate 122 is provided as a positioning device with a horizontal slot 124 being parallel to the double arrow A, located behind the oblique slots 104 of the upper shed 108 (in FIG. 2 on the right-hand side). At the lower end of the third main carrier 16, there is provided a horizontal slot plate 126 with a horizontal slot 128.

As the main carriers 12, 14, 16 are pivoted by their related parallelogram linkages 18, 30, 34, correspondingly, the needle carriers 98, 118, slot plates 102, 110 and the positioning devices 122, 126 are pivoted between respective first and second end positions.

FIG. 2 in particular shows that the opening of the upper shed 108 and the lower shed 106 is effected at the same time, due to this arrangement. The lower demarcation of the upper shed 108 is formed by stationary threads 130 which, coming from the right in FIG. 2, are guided through a guidance aperture 132 in the needle carrier 118, then run along the respective needle 120 and through a needle eye 134 at the free end of the needle in order to then run off, basically horizontally, into the direction of the finished fabric 136. The upper demarcation of the upper shed 108 is formed by crossing threads 138 which are at first guided through the horizontal slot 124 and then through the oblique slots 104, in order to then run diagonally downwards to the finished fabric 136, as shown in FIG. 2. In the case of the upper shed 108 being open in the way according to FIG. 2, (in the following designated "first shed positioning"), a weft thread can be inserted for example with the help of a shuttle rod 140 indicated in FIG. 2.

In the same manner, the open lower shed 106 is demarcated by stationary threads 142 which run though a guidance aperture 144 in the lower needle carrier 98, then through related needle eyes 146 at the free ends of the needles in order to then run off, basically horizontally, to the finished fabric 136. The lower shed demarcation is formed by crossing threads 148 which first run through the horizontal slot 128, then intersperse the oblique slots 112 to then run diagonally upwards to the finished fabric 136, as shown in FIG. 2. Again, a rapier rod 150 (respectively a rapier rod pair with a sending rod and a receiving rod which are not shown) serves to insert the weft in the lower shed 106.

Figure 3:
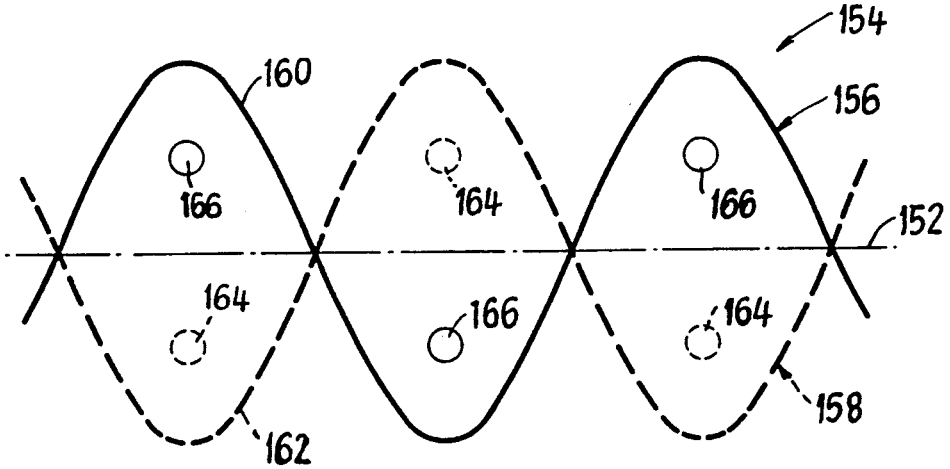
FIG. 3 is a schematic section through a double woven fabric.

It can already be seen in FIG. 2 that non-fraying edges of a double woven fabric, manufactured with the help of the crossing device 10, have the same weaving structure without a phase shift of, for example, one weft, however, symmetrical around a reflecting plane parallel to the fabric plane (corresponding to the cutting plane 152, indicated with a dot-dash line in FIG. 3, for the splitting of the double woven fabric 154 in an upper woven fabric (upper fabric) 156 and in a lower woven fabric (lower fabric) 158).

The described structure of the device 10 with simultaneous shed opening in the upper shed 108 and the lower shed 106 (first shed positioning) and correspondingly simultaneous changeover of the crossing threads 138 and 148 in a second shed positioning (with the oblique slots 104 being arranged below the needle eyes 134 and with the oblique slots 112 being arranged respectively above the needle eyes 146), makes the preparation of the changeover for both sheds 106 and 108 possible. This preparation is made already in the first shed positioning according to FIG. 1, with the third main carrier 16 being shifted in relation to the first and second main carriers 12 and 14 which are unchanged in their position at present, in order to move the crossing threads 138 and 148 within the oblique slots 104 or 112 from one end to the opposite end. The actual changeover with respect to the stationary threads 130, 142 cannot yet take place, as the crossing threads 138, 148 are still running between the needles 100 or 120. The crossing threads 138, 148 will correspondingly lean at the side of the respective needle 100, 120 under a pretension corresponding to the thread tension.

Not until the crossing threads 138, 148 leave the respective region of the needle in the course of the transition from the first to the second shed positioning, can these change sides abruptly while forming a corresponding crossover with the related stationary threads 130, 142. This crossover being established abruptly then travels in the direction of the finished fabric 136 and is, in addition to that, moved forward by the related stationary thread 130 or 142 during the change of shed. The result is, in the following first shed positioning, a shed 106, 108 formed clearly between the stationary thread 130,142 and the crossing thread 138, 148 in which the following weft is inserted. This weft reliably binds the crossing after the stroke of the weaving reed, which is not shown, against the finished fabric 136.

With the aforedescribed crossing device 10 in a double woven fabric 154 a non-fraying edge 168, 170 in the upper fabric 156 and the lower fabric 158 can be manufactured with an alternate weft insertion in the upper shed 108 or the lower shed 106. Double woven fabrics 154 with alternate weft insertion according to FIG. 3 are manufactured to obtain a double woven fabric 154 having a weaving structure corresponding to a woven fabric manufactured on a single-rapier loom, that is to say with one pile loop for each weft. If both wefts are inserted simultaneously in the upper shed 108 and the lower shed 106 on a double-rapier loom, the warp threads would therefore have to be guided in the opposite direction (counter-current warp thread 160 shown in FIG. 3 as a broken line in comparison to the normal warp thread 162). The result would be a doubling of the amount of warp threads with the necessity to use a jacquard loom with double the capacity. In order to avoid the weaving in the opposite direction, the wefts 164, indicated with a dash-line contour according to FIG. 3, are left out alternately in the upper shed 108 and the lower shed 106. Correspondingly only the wefts 166 indicated with a continuous line are inserted alternately in the upper shed 108 and the lower shed 106.

Figure 4:
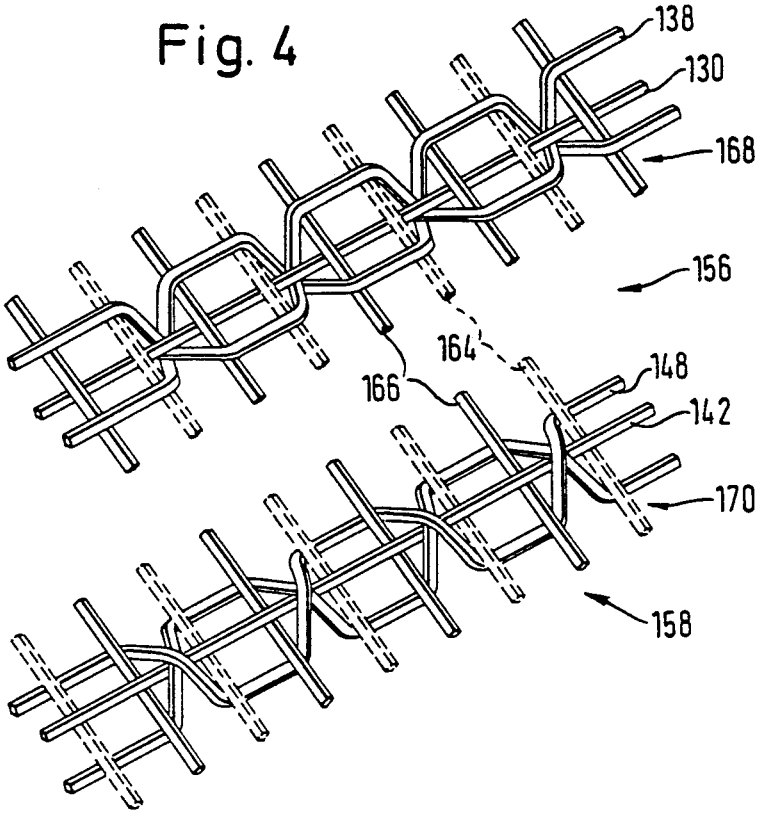
FIG. 4 is a perspective representation of a cross weave according to the invention in the upper fabric and the lower fabric of a double woven fabric.
Figure 5:
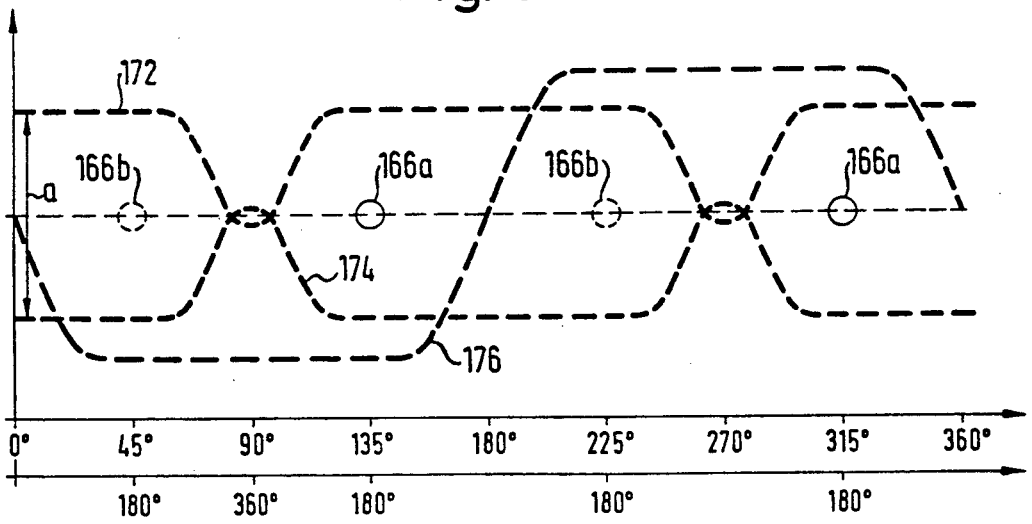
FIG. 5 is a control diagram representing the use of the device according to FIGS. 1 and 2 to obtain the cross weave according to FIG. 4.

In order to produce, even in the case of such a double woven fabric 154 with alternate weft insertion, a clear cross weave in the upper fabric 156 and in the lower fabric 158, the change of shed is carried out according to FIGS. 4 and 5. A non-fraying edge 168 of the upper fabric 156 and a non-fraying edge 170 of the lower fabric 158 manufactured according to the invention, are indicated at the top and the bottom of FIG. 4, respectively.

FIG. 5 shows a control diagram for the guidance of the needle carrier 118, the slot plate 102 and the horizontal slot plate 122, for instance of the upper shed 108, with the indication of the respective weft insertion, (continuous contour for the inserted wefts **166*a*). Due to the rigid coupling of the needle carriers, the slot plates 98, 102 and 118, 120 respectively, and the horizontal slot plates 122, 126 over the respective main carriers 12, 14 16, this diagram corresponds in principle to the diagram for the lower fabric 158, however, with a lagging weft insertion (dash-line contour for the wefts 166*b* in the lower shed 106**).

A line 172 in FIG. 5 indicates the momentary position of the crossing threads 138 (slot plate 102) and correspondingly a line 174 indicates the momentary position of the stationary threads 130 (needle eyes 134). The distance between the needle eyes 134 and the oblique slots 104 in the first shed positioning (open shed) shown in FIG. 2, corresponds to distance a (lifting of shed) between the lines 172 and 174 in the front region of the diagram, as indicated in FIG. 5. The second shed positioning (see also FIG. 1), is at 90 degrees and at 270 degrees. It can be noticed that the crossing threads 138 have been moved downwards by a little more than half of the shed lifting a compared to the first shed positioning and correspondingly the stationary threads 130 have been moved upwards by a little more than half the shed lifting a. The needle carrier 118 and the slot plate 102 respectively, merely perform a lifting movement slightly exceeding half of the lifting of the shed. The sheds are closed in the second shed positioning by the stationary threads and the crossing threads.

A line 176 indicates the movement of the positioning device (horizontal slot plate 122). It can be seen that the position change of the positioning device is performed at 180 degrees. The position change is therefore performed approximately at the half-time of the open period of the shed in the first shed positioning. The frequency with which the position of the positioning device has to be changed corresponds to half the frequency of the change of shed.

The center of the weft insertion angle in the upper shed 108 in relation to one rotation of the primary shaft of the crossing device is at 135 degrees and at 315 degrees. In comparison, the middle of the weft insertion angle in the lower shed is at 45 degrees and at 225 degrees, i.e. after the position change of the positioning device. The primary shaft for the crossing device rotates in proportion 1:4 in relation to the main shaft of the loom. In FIG. 5, the upper abscissa shows the phase of the primary shaft of the crossing device while the lower abscissa indicates the phase of the main shaft of the loom.

Since, as mentioned above, the position change of the positioning device is still effected in the first shed positioning, but the actual changeover not until the transition from the first shed positioning to the second shed positioning (shortly before 90 degrees or shortly before 270 degrees), exactly at the time when the crossing threads 138 are able to move past the needle tips, the changeover is prepared through this proceedings so that it can be effected abruptly when the crossing threads 138 pass the needles 120.

Since the first shed positioning and the second shed positioning each in the upper and the lower shed 108, 106 are occupied at the same time, the preparation for the changeover for both sheds 108,106 takes place at the same time. The crossover in both sheds 106,108 resulting at the transition into the second shed positioning is therefore reliably bound from the following weft **166*a* and 166*b*** respectively.

A cross weave in the upper fabric 156 and in the lower fabric 158, as indicated in FIG. 4, is obtained. The left-out wefts 164 according to FIG. 3 are again indicated with a dash-line contour in FIG. 4.

I claim:

1. A cross device (10) for an upper end and a lower shed of a double-rapier loom for the weaving of a double woven fabric (154), comprising per shed a needle carrier (98, 118) with at least one elongated stationary needle (100,120), said stationary needle (100, 120) having two ends, one end of which, the fastening end, being fixed to said needle carrier, the other, free end being provided with a needle eye for the guidance of a stationary thread (130, 142), said needle carrier (98, 118) being movable between a first end position and a second end position, a slot plate (102, 110) with at least one oblique slot (104, 112) for the guidance of a crossing thread (138, 148), said slot plate being movable between a first end position and a second end position, a positioning device (122, 126) with at least one eye for the positioning of said crossing thread (138, 148) in the respective oblique slot (104, 112) of said slot plate (102, 110) for the changeover of said crossing thread (138, 148) relative to an associated stationary thread (130, 142) by a corresponding shift of said positioning device (122, 126) relative to said slot plate (102, 110), said positioning device (122, 126) being movable between a first end position and a second end position, and a first and second main carrier (12, 14) which are movable in a vertical direction in relation to each other, said needle carrier (98, 118) of one of said two sheds being attached to one of said two main carriers (12, 14) and said slot plate (102, 110) of the one shed being attached to the respective other main carrier (12, 14), a third main carrier (16) to which said positioning devices (122, 126) of said two sheds (106, 108) are attached and which is movable in the vertical direction in relation to said first and second main carrier (12, 14), characterized in that said needle carrier (118) of said upper shed (108) and said slot plate (110) of said lower shed (106) are fixed to said first main carrier (12), that said needle carrier (98) of said lower shed (106) and said slot plate (102) of said upper shed (108) are fixed to said second main carrier (14), and that said two main carriers (12, 14) carry said needle carriers (98, 118) and said slot plates (102, 110) staggered in such a way that said needles (100, 120) of said needle carriers (98, 118) each are disposed at that side of said slot plate (102, 110) which faces a finished fabric (136) woven by said loom.

2. A device according to claim 1, wherein said positioning device comprises a perforated plate (122, 126).

3. A device according to claim 1, wherein one of said two main carriers (12, 14) is provided with a right-angle bend (116) for mounting its needle carrier (98, 118) at one side of the other main carrier (12, 14) and for mounting its slot plate (102, 110) at the other side of the other main carrier (12, 14).

4. A device according to claim 1, wherein said main carriers (12, 14, 16) are each movable by a system of pivoted levers.

5. A device according to claim 4, wherein said system of pivoted levers is a parallelogram linkage.

6. A method for the manufacture of non-fraying edges (168, 170) of a double-woven fabric (154) on a double-rapier loom using a double-shed crossing device for an upper shed (108) and a lower shed (106), said crossing device comprising per shed (106, 108);

a needle carrier (98, 118) with at least one elongated stationary needle (100, 120), said stationary needle (100, 120) having two ends, one end of which, the fastening end, being fixed to said needle carrier, the other, free end being provided with a needle eye for the guidance of a stationary thread (130, 142), said needle carrier (98, 118) being movable between and first end position and a second end position;

a slot plate (102, 110) with at least one oblique slot (104, 112) for the guidance of a crossing thread (138, 148), said slot plate being movable between a first end position and a second end position;

a positioning device (122, 126) with at least one eye for the positioning of said crossing thread (138, 148) in the respective oblique slot (104, 112) of said slot plate (102, 110) for the changeover of said crossing thread (138, 148) relative to an associated stationary thread (130, 142) by a corresponding shift of said positioning device (122, 126) relative to said slot plate (102, 110), said positioning device (122, 126) being movable between a first end position and a second end position;

the method comprising the steps of:

(A) moving said needle carrier (98, 118) and said slot plate (102, 110) in their respective first end positions with said positioning device (122, 126) being in one of its first and second end positions, said needle carrier and said slot plate thereby defining a first shed positioning of said crossing device, in which first shed positioning said crossing threads (138, 148) are guided passed said stationary needles (100, 120) between said free ends and said fastening ends thereof;

(B) keeping said crossing device in said first shed positioning for a time period;

(C) inserting a weft in one of said upper shed (108) and said lower shed (106) during said time period and subsequently inserting a weft in the other of said upper shed and lower shed during said time period;

(D) moving said positioning device (122, 126) from said one end position to the other of its first and second end positions during said time period for preparing a changeover of said crossing threads (138, 148) in relation to said stationary threads (130, 142) in the respective shed; and (E) moving said needle carrier (98, 118) and said slot plate (102, 110) in their respective second end positions after elapse of said time period, thereby defining a second shed positioning of said crossing device, in which second shed positioning said cross threads (138, 148) are guided outside of the region of said stationary needles (100, 120) and thus are changing over in relation to said stationary threads (130, 142) in the respective shed (106, 108) due to said positioning device (122, 126) being in its other end position.

7. A method according to claim 6, wherein in step (A), said needle carriers (98, 118) and said slot plates (102, 110) of said upper and lower sheds (106, 108) are moved in an open shed position of said upper and lower sheds, in step (E), said needle carriers (98, 118) and said slot plates (102, 110) of said upper and lower sheds (106, 108) are moved in a closed shed position of said upper and lower sheds (106, 108), step (A) and step (E) immediately succeed one another alternatingly, and, in step (A) and step (E) the needle carrier (98, 118) and said slot plates (102, 110) each perform a lifting movement with a height slightly exceeding half of the maximum distance of said stationary threads (130, 142) from said crossing threads (138, 148) in said first shed positioning.

8. A method according to claim 6, wherein step (D) is performed between two weft insertions of step (C).

9. A method according to claim 6, wherein a perforated plate (122, 126) is used as said positioning device.

* * * * *